United States Patent [19]

Groeger et al.

[11] Patent Number: 4,844,032

[45] Date of Patent: Jul. 4, 1989

[54] VENTING ARRANGEMENT WITH INTEGRATED OIL SEPARATOR

[75] Inventors: Klaus Groeger, Hemmingen; Winfried Disteirath, Dedenbach, both of Fed. Rep. of Germany

[73] Assignee: Inh. h.c.F. Porsche Aktiengesellschaft, Stuttgart, Fed. Rep. of Germany

[21] Appl. No.: 178,217

[22] Filed: Apr. 6, 1988

[30] Foreign Application Priority Data

Apr. 18, 1987 [DE] Fed. Rep. of Germany ..... 3713210

[51] Int. Cl.[4] ..... F01M 1/00

[52] U.S. Cl. ..... 123/196 R; 123/574

[58] Field of Search ..... 123/196 R, 574, 573, 123/572, 41.84

[56] References Cited

U.S. PATENT DOCUMENTS 4,517,951 5/1985 Otaka et al. ..... 123/573

4,602,607 7/1986 Balsley ..... 123/574

4,768,493 9/1988 Ohtaka et al. ..... 123/573

FOREIGN PATENT DOCUMENTS 3509439 9/1985 Fed. Rep. of Germany ..... 123/574

2134976 8/1984 United Kingdom ..... 123/574

*Primary Examiner*—E. Rollins Cross

*Attorney, Agent, or Firm*—Barnes & Thornburg

[57] ABSTRACT

A venting arrangement with integrated oil separator is arranged at a crankcase of an internal combustion engine with preferably V-shaped cylinder rows and includes a housing with the oil separator. The housing is formed for reasons of structural simplification by an upper part and by a lower part which have both pot-shaped configuration and upright, mutually overlapping boundary walls and form a unit. The boundary walls of the upper part are supported at the crankcase by means of flanges which assures a simple installation of the venting arrangement.

25 Claims, 2 Drawing Sheets

VENTING ARRANGEMENT WITH INTEGRATED OIL SEPARATOR

BACKGROUND AND SUMMARY OF THE INVENTION

The present invention relates to a venting arrangement with integrated oil separator for a crankcase of an internal combustion engine, preferably with V-shaped arranged cylinder rows, in which the venting arrangement and the oil separator are components of a housing provided with baffle plates.

The DE-OS No. 35 09 439 discloses a venting system for internal combustion engine crankcases which is provided above a cylinder head and together with a cover, forms a unit. This construction requires not only a relatively large amount of space within the area of the cylinder head where customarily a camshaft extends but also impairs the free design of the cover.

A venting arrangement with oil separator is disclosed in the U.S. Pat. No. 3,469,565 which, by reason of a large number of different components, is costly with respect to manufacture and installation.

It is therefore the object of the present invention to provide a venting arrangement with integrated oil separator for an internal combustion engine which with good functioning is simple in construction as well as manufacturable in a cost-favorable manner and can be easily installed into the crankcase without influencing other components.

The underlying problems are solved according to the present invention in that the housing is formed essentially only by an upper part and a lower part which have a pot-shaped configuration and upright, overlapping boundary walls of which the boundary walls of the upper part are supported on a wall of the crankcase extending horizontally between the cylinder rows and provided with an opening for receiving the lower part.

The principal advantages achievable with the present invention resides in that the venting arrangement with integrated oil separator (gravity oil separator) is formed exclusively by two pot-shaped structural parts, namely, by an upper part and by a lower part, which can be easily manufactured and installed. They can be inserted without difficulty as a unit into the crankcase and more particularly into a wall which extends between the V-shaped cylinder rows of the internal combustion engine.

The weight and the manufacturing costs of the venting arrangement can be favorably influenced if the upper part and the lower part are made of plastic material and are connected with each other by a non-detachable plug-in connection. If the baffle plates are formed by ribs provided at the upper part and lower part, then a functionally correct guidance of the venting medium is assured together with a good oil separation effect.

BRIEF DESCRIPTION OF THE DRAWINGS

These and other objects, features and advantages of the present invention will become more apparent from the following description when taken in connection with the accompanying drawing which shows, for purposes of illustration only, two embodiments in accordance with the present invention, and wherein.

DETAILED DESCRIPTION OF THE DRAWINGS

Figure 2:
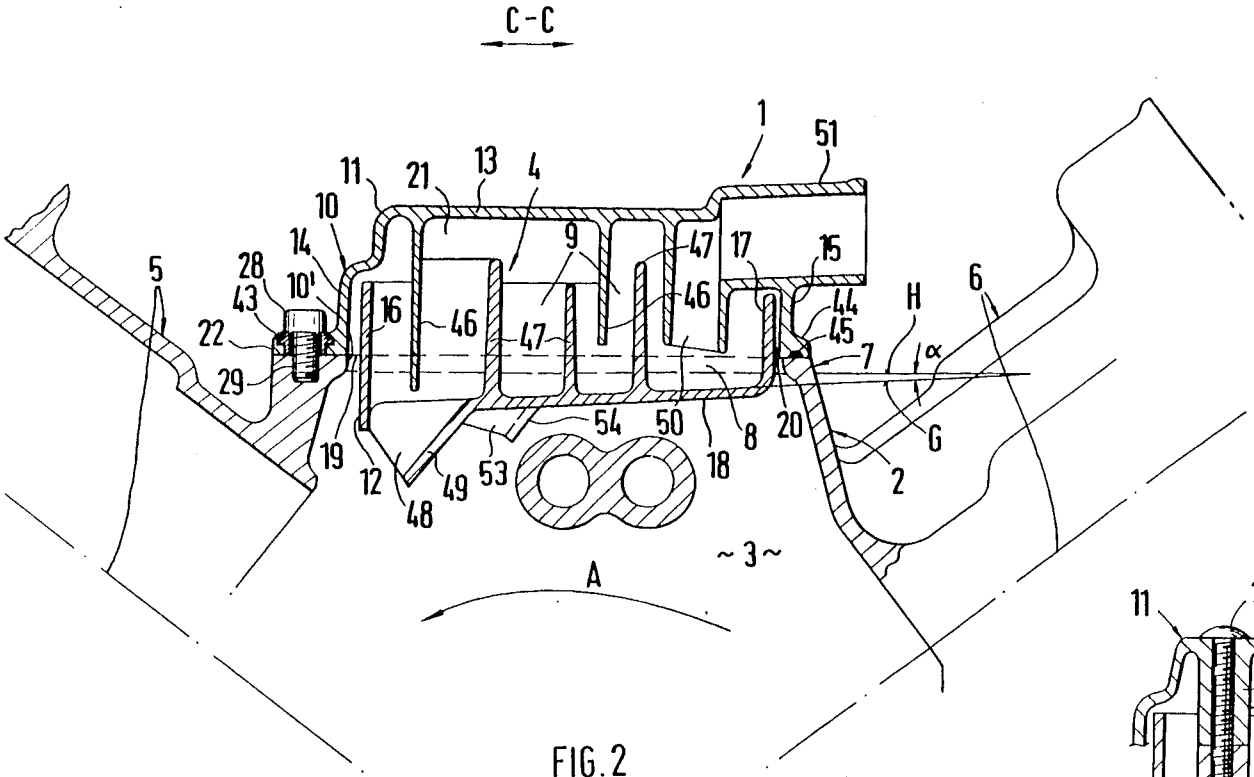
FIG. 2 is a cross-sectional view taken along line II—II of FIG. 1, whereby this cross section is also a partial cross section of the internal combustion engine.

Referring now to the drawing wherein like reference numerals are used throughout the various views to designate like parts, the venting arrangement generally designated by reference numeral 1 is secured at a crankcase generally designated by reference numeral 2 (FIG. 2) of an internal combustion engine (not shown in detail) and has the task to purify the venting medium which is produced during the operation of the internal combustion engine in a space 3 of the crankcase and is enriched with oil—it contains blow-by gases—and which enters between cylinder and piston into the space 3. The oil, which is admixed to the venting medium is thereby to be separated which takes place by means of the oil separator generally designated by reference numeral 4 that is integrated into the venting arrangement 1.

The crankcase 2 includes between two V-shaped arranged cylinders rows 5 and 6 which form a unit with the crankcase 2, a raised portion 7, which is delimited by a horizontal wall 8. The wall 8 accommodates the venting arrangement 1 together with the oil separator 4 provided with several baffle plates 9.

The venting arrangement 1 and the oil separator 4 are components of a housing generally designated by reference numeral 10 which is formed by an upper part 11 and by a lower part 12. The upper part 11 thereby includes a horizontally extending cover 13 and upright boundary walls 14 and 15; the lower part 12 includes a bottom 18 extending transversely to the upright boundary walls 16 and 17, whereby the boundary walls 16 and 17 rest in an opening 10' of the wall 10. The open sides of the upper part 11 and of the lower part 12 mutually face one another and the upright boundary walls 14, 15, respectively, 16, 17, mutually overlap. Stated differently, the boundary walls 16 and 17 extend sectionwise inside of the boundary walls 14 and 15. The lower part 12 is thereby so constructed dimensionally that passage gaps 19 and 20 result between the boundary walls 14, 15, respectively, 16, 17, which lead into the interior space 21 of the housing 10.

The boundary walls 14 and 15 of the upper part 11 are supported by means of flanges 22 and 23 at the wall 8 of the crankcase 2 (FIG. 3) and are secured at 24, 25, 26 and 27 by means of screws 28. A respective screw 28 extends through the flange 22, respectively, 23 and is screwed into a thread 29 of the crankcase 2.

Figure 4:
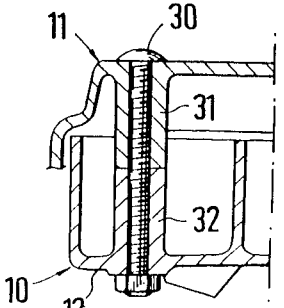
FIG. 4 is a partial view according to FIG. 3 of a modified embodiment in accordance with the present invention.

The upper part 11 and the lower part 12 can be each made of a light metal alloy. Screws 30 serve for their connection which extend through mutually supporting fastening eyes 31 and 32, arranged inside of the upper part 11 and the lower part 12 (FIG. 4).

Figure 3:
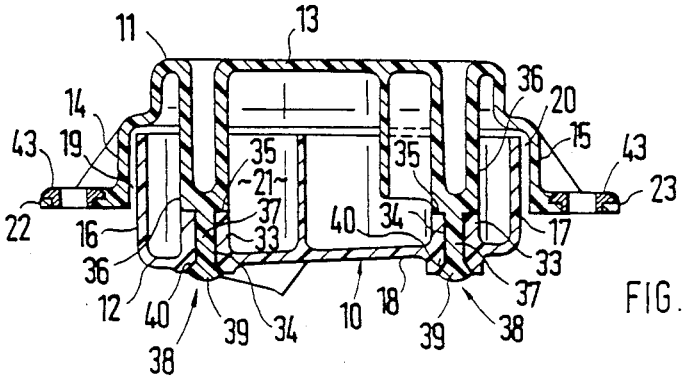
FIG. 3 is a cross-sectional view taken along line III—III of FIG. 1.

According to FIG. 3, the upper part 11 and the lower part 12 consist of plastic material. The lower part 12 thereby includes at least one upright mounting portion 33 (FIG. 3) with a through-channel 34. A support 36 which is extended to the mounting portion 33, by means of a shoulder 35 is provided at the cover 13 of the upper part 11. The support 36 includes a pin 37 constructed as prolongation which extends inside of the through-channel 34, and on its free side 38 is supported in a local enlargement 40 of the through-channel 34 by means of a thickened portion 39. The thickened portion 39 is made by heat treatment of the pin 37. In order to establish a functionally-correct support of the upper part 11 and of the lower part 12, connections identical in principle are additionally provided at 41 and 42. Furthermore, the flanges 22 and 23 of the upper part 11 mde of plastic material are provided with metallized support bushings 43 within the area of the screws 28. Therebeyond, a sealing member 45 may be provided between a support flange 44 of the upper part 11 and the wall 8 of the crankcase 2.

Figure 1:
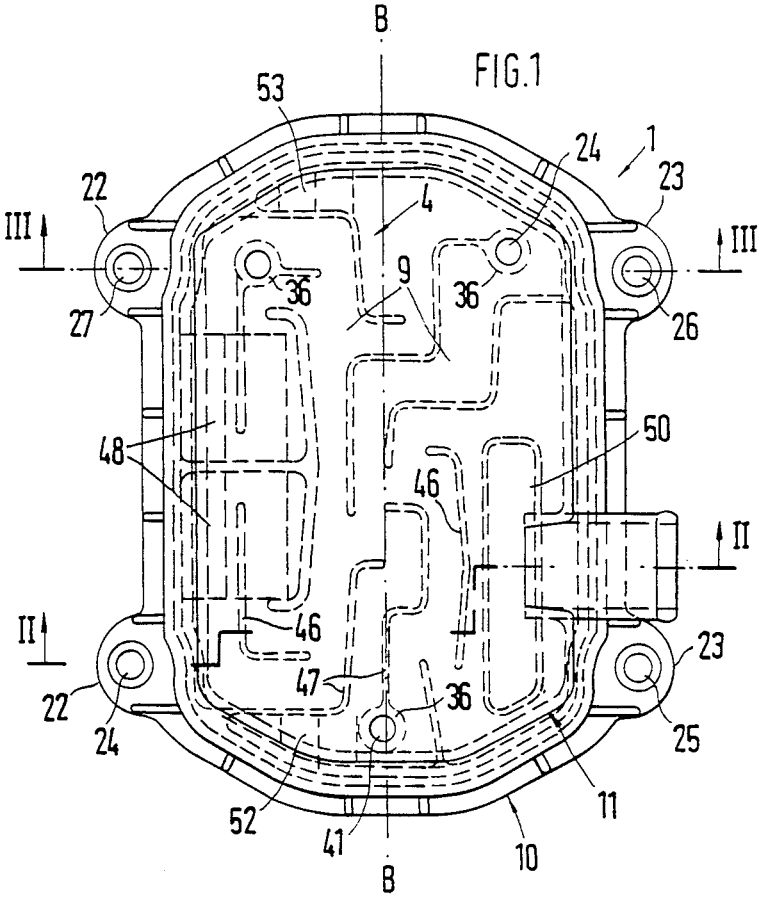
FIG. 1 is a top plan view on a venting arrangement according to the present invention.

The baffle plates 9 of the oil separator 4 are provided at the upper part 11 and at the lower part 12 and are formed by webs 46 and 47 which overlap sectionwise. The webs 46 and 47 form according to FIG. 1 a type of labyrinth through which the gases of the venting medium escape and the oil contained therein is separated.

The lower part 12 includes an inlet 48 (FIG. 2) which is provided adjacent the boundary wall 16. The inlet 48 is provided with a deflection element 49 which prevents the entrance of oil particles into the housing 10 by oil particles accelerated in the direction of rotation A of the crankshaft (not shown). An outlet of the venting medium freed of the oil is provided at 50, whereby the outlet 50 is provided at the upper part 11 on the side thereof opposite the inlet 48. The outlet 50 includes a pipe connection 51 which is connected with the suction pipe installation (not shown) of the internal combustion engine.

The bottom 18 of the lower part 12 is provided at opposite sides—as viewed in the longitudinal direction B—B (FIG. 1) of the internal combustion engine—with outlet openings 52 and 53 (FIGS. 1 and 2) which also includes deflection elements 54 that have the function of the deflection element 49. In order that the medium flows toward the oil outlet openings 52 and 53, the bottom 18 has a slope G—angle $\alpha$—at least in the transverse direction (FIG. 2) with respect to a horizontal H.

While we have shown and described only two embodiments in accordance with the present invention, it is understood that the same is not limited thereto but is susceptible of numerous changes and modifications as known to those skilled in the art, and we therefore do not wish to be limited to the details shown and described herein but intend to cover all such changes and modifications as are encompassed by the scope of the appended claims.

We claim:

1. A venting arrangement with an integrated oil separator means for a crankcase of an internal combustion engine, comprising housing means provided with baffle plate means, the venting arrangement and the oil separator means being component of the housing means, the housing means being formed essentially only by an upper part and by a lower part which have pot-shaped configuration and upright, mutually overlapping boundary wall means, and gthe boundary wall means of the upper part being supported at a wall of the crankcase provided with an opening for receiving the lower part.

2. A venting arrangement according to claim 1, in which the internal combustion engine is provided with V-shaped cylinder rows, wherein the boundary wall means of the upper part are supported at said wall of the crankcase which extends substantially horizontally between the cylinder rows.

3. A venting arrangement according to claim 2, wherein the boundary wall means of the upper part are supported at said wall by flange means.

4. A venting arrangement according to claim 3, wherein the boundary wall means of the upper part are secured at the wall by threaded means.

5. A venting arrangement according to claim 3, wherein the connection of the upper part with the lower part takes place by threaded means.

6. A venting arrangement according to claim 5, wherein the upper part and the lower part consist of a light metal alloy.

7. A venting arrangement according to claim 4, wherein the upper part and the lower part consist of plastic material.

8. A venting arrangement according to claim 4, wherein at least one substantially upright mounting means having a through-channel is provided between the upper part and the lower part, the upper part including support means having a shoulder abutting at said mounting means, said support means including a pin extending inside of the through-channel and being supported on the free side of the through channel with a thickened portion.

9. A venting arrangement according to claim 8, wherein the mounting means is provided at the lower part and the support means at the upper part.

10. A venting arrangement according to claim 8, wherein the flange means are provided within the area of the threaded means with metallized support bushings.

11. A venting arrangement according to claim 1, wherein the baffle plate means are formed by at least partially overlapping webs of the upper part and of the lower part.

12. A venting arrangement according to claim 1, wherein the lower part includes an inlet for the venting medium which is arranged adjacent one of the boundary wall means in such a manner that a deflection element of the inlet prevents the direct entry of oil particles accelerated in the direction of rotation of the crankshaft.

13. A venting arrangement according to claim 12, wherein an outlet is provided for the venting medium freed of oil at the upper part on the side opposite the inlet.

14. A venting arrangement according to claim 13, wherein the outlet includes a short pipe connection adapted to be connected with a suction pipe of the internal combustion engine.

15. A venting arrangement according to claim 1, wherein the lower part is provided with oil return openings.

16. A venting arrangement according to claim 15, wherein the oil return openings are provided at opposite sides.

17. A venting arrangement according to claim 15, wherein the bottom of the lower part has a slope in such a manner that the oil separated from the venting medium flows back into the crankcase.

18. A venting arrangement according to claim 1, wherein the boundary wall means of the upper part are supported at said wall by flange means and are secured thereat.

19. A venting arrangement according to claim 1, wherein the connection of the upper part with the lower part takes place by threaded means.

20. A venting arrangement according to claim 1, wherein the upper part and the lower part consist of a light metal alloy.

21. A venting arrangement according to claim 1, wherein the upper part and the lower part consist of plastic material.

22. A venting arrangement according to claim 21, wherein at least one substantially upright mounting means having a through-channel is provided between the upper part and the lower part, the upper part including support means having a shoulder abutting at said mounting means, said support means including a pin extending inside of the through-channel and being supported on the free side of the through channel with a thickened portion.

23. A venting arrangement according to claim 22, wherein the mounting means is provided at the lower part and the support means at the upper part.

24. A venting arrangement according to claim 18, wherein the flange means are provided within the area of threaded means with metallized support bushings.

25. A venting arrangement according to claim 1, wherein the bottom of the lower part has a slope in such a manner that the oil separated from the venting medium flows back into the crankcase.

* * * * *